US010971047B2

(12) United States Patent
Chen et al.

(10) Patent No.: US 10,971,047 B2
(45) Date of Patent: Apr. 6, 2021

(54) DEVICE SUBSTRATE

(71) Applicant: Au Optronics Corporation, Hsinchu (TW)

(72) Inventors: Chia-Heng Chen, Kaohsiung (TW); Yi-Fu Chen, Kaohsiung (TW); Ping-Hung Shih, Hsinchu (TW); Wei-Chieh Sun, Hsinchu (TW); Peng-Che Tai, Hsinchu (TW); Jhih-Ci Chen, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 3 days.

(21) Appl. No.: 16/595,482

(22) Filed: Oct. 8, 2019

(65) Prior Publication Data

US 2020/0410914 A1 Dec. 31, 2020

(30) Foreign Application Priority Data

Jun. 28, 2019 (TW) ..... 108122810

(51) Int. Cl.
*G09G 3/20* (2006.01)

(52) U.S. Cl.
CPC ..... *G09G 3/20* (2013.01); *G09G 2300/0408* (2013.01); *G09G 2300/08* (2013.01); *G09G 2310/0202* (2013.01); *G09G 2310/0267* (2013.01); *G09G 2310/08* (2013.01)

(58) Field of Classification Search
CPC ..... G09G 3/20; G09G 2300/0408; G09G 2300/08; G09G 2310/0202; G09G 2310/0267; G09G 2310/08
USPC ..... 345/213
See application file for complete search history.

(56) References Cited

U.S. PATENT DOCUMENTS

| | | | | |
|---|---|---|---|---|
| 9,478,310 | B2 | 10/2016 | Han et al. | |
| 9,576,678 | B2 | 2/2017 | Lin et al. | |
| 9,607,712 | B1 | 3/2017 | Lin et al. | |
| 10,283,066 | B2 | 5/2019 | Hao | |
| 2014/0240209 | A1* | 8/2014 | Zhang | G11C 19/28 345/92 |
| 2015/0255014 | A1 | 9/2015 | Lin et al. | |
| 2015/0294636 | A1* | 10/2015 | Yu | G09G 3/3655 345/204 |
| 2016/0012911 | A1 | 1/2016 | Han et al. | |

(Continued)

FOREIGN PATENT DOCUMENTS

| | | |
|---|---|---|
| CN | 103761937 | 4/2014 |
| CN | 106847227 | 6/2017 |

(Continued)

*Primary Examiner* — Mark Edwards
(74) *Attorney, Agent, or Firm* — JCIPRNET

(57) ABSTRACT

A device substrate including a substrate and 1st-stage to nth-stage driver units. Each of the 1st-stage to nth-stage driver units includes a pulldown element, a reset element, and an output element. A gate of the pulldown element is used for receiving a corresponding first start signal or a reset signal. A gate of the reset element is used for receiving the reset signal. A drain of the output element is used for outputting a corresponding gate driving signal. A gate of the pulldown element of the nth-stage driver unit is electrically connected with the gate of the reset element of the nth-stage driver unit so as to make the gate of the pulldown element of the nth-stage driver unit be used for receiving the reset signal.

14 Claims, 12 Drawing Sheets

(56) References Cited

U.S. PATENT DOCUMENTS

| | | | | |
|---|---|---|---|---|
| 2017/0076821 | A1 | 3/2017 | Lin et al. | |
| 2018/0095315 | A1 | 4/2018 | Yoon et al. | |
| 2018/0374442 | A1 | 12/2018 | Hao | |
| 2019/0139616 | A1* | 5/2019 | Qian ..... | G11C 19/28 |

FOREIGN PATENT DOCUMENTS

| | | |
|---|---|---|
| CN | 107885001 | 4/2018 |
| TW | I514362 | 12/2015 |
| WO | 2016106847 | 7/2016 |
| WO | 2019090912 | 5/2019 |

* cited by examiner

DEVICE SUBSTRATE

CROSS-REFERENCE TO RELATED APPLICATION

This application claims the priority benefit of Taiwan application serial no. 108122810, filed on Jun. 28, 2019. The entirety of the above-mentioned patent application is hereby incorporated by reference herein and made a part of this specification.

BACKGROUND OF THE DISCLOSURE

Field of the Disclosure

The present disclosure relates to a device substrate, and particularly to a device substrate including a 1st-stage driver unit to an nth-stage driver unit.

Description of Related Art

With the development of technology, simply improving the display quality of display panels cannot easily meet the consumer demand for new products. In order to increase the attractiveness of the products, various manufacturers are committed to the research and development of special-shaped display panels. Different from the conventional rectangular display panel, the variability of the appearance of the special-shaped display panel can attract the attention of consumers.

Currently, a large panel is typically cut to obtain a special-shaped display panel in a specific shape, thereby saving the cost of a photomask required to manufacture the special-shaped display panel. However, after the cutting process, a signal source of some of driver units is removed, causing the display abnormality of the display panel.

SUMMARY OF THE DISCLOSURE

The present disclosure provides a device substrate which can relieve the problem of display abnormality of a display panel.

At least one embodiment of the present disclosure provides a device substrate. The device substrate includes a substrate and a 1st-stage driver unit to an nth-stage driver unit located on the substrate. n is a positive integer. Each of the 1st-stage to nth-stage driver units includes a pulldown element, a reset element, and an output element. A gate of the pulldown element is used for receiving a corresponding first start signal or a reset signal. A source of the pulldown element is used for receiving a first voltage signal. A gate of the reset element is used for receiving the reset signal. A source of the reset element is used for receiving a second voltage signal. A gate of the output element is electrically connected to a drain of the pulldown element and a drain of the reset element. A source of the output element is used for receiving a corresponding high-frequency clock signal. A drain of the output element is used for outputting a corresponding gate driving signal. A gate of the pulldown element of the nth-stage driver unit is electrically connected with the gate of the reset element of the nth-stage driver unit so as to make the gate of the pulldown element of the nth-stage driver unit be used for receiving the reset signal.

At least one embodiment of the present disclosure provides a device substrate. The device substrate includes a substrate, and a reset signal line, a first voltage signal line, a second voltage signal line, a plurality of high-frequency clock signal lines and a 1st-stage driver unit to an nth-stage driver unit located on the substrate. n is a positive integer. Each of the 1st-stage driver unit to the nth-stage driver unit includes a first start signal line, a pulldown element, a reset element and an output element. A gate of the pulldown element is electrically connected to the first start signal line. A source of the pulldown element is electrically connected to the first voltage signal line. A gate of the reset element is electrically connected to the reset signal line. A source of the reset element is electrically connected to the second voltage signal line. A gate of the output element is electrically connected to a drain of the pulldown element and a drain of the reset element. A source of the output element is electrically connected to the corresponding high-frequency clock signal line. A drain of the output element is used for outputting a corresponding gate driving signal. The first start signal line of the nth-stage driver unit is electrically connected to the reset signal line.

In order to make the aforementioned and other objectives and advantages of the present disclosure comprehensible, embodiments accompanied with figures are described in detail below.

DESCRIPTION OF THE EMBODIMENTS

It should be understood that although terms such as "first", "second", and "third" in this specification may be used for describing various elements, components, areas, layers, and/or parts, the elements, components, areas, layers, and/or parts are not limited by such terms. The terms are only used to distinguish one element, component, area, layer, or part from another element, component, area, layer, or part. Therefore, the "first element", "component, "area", "layer", or "part" described below may also be referred to as a second element, component, area, layer, or part without departing from the teachings of the present disclosure.

Figure 1:
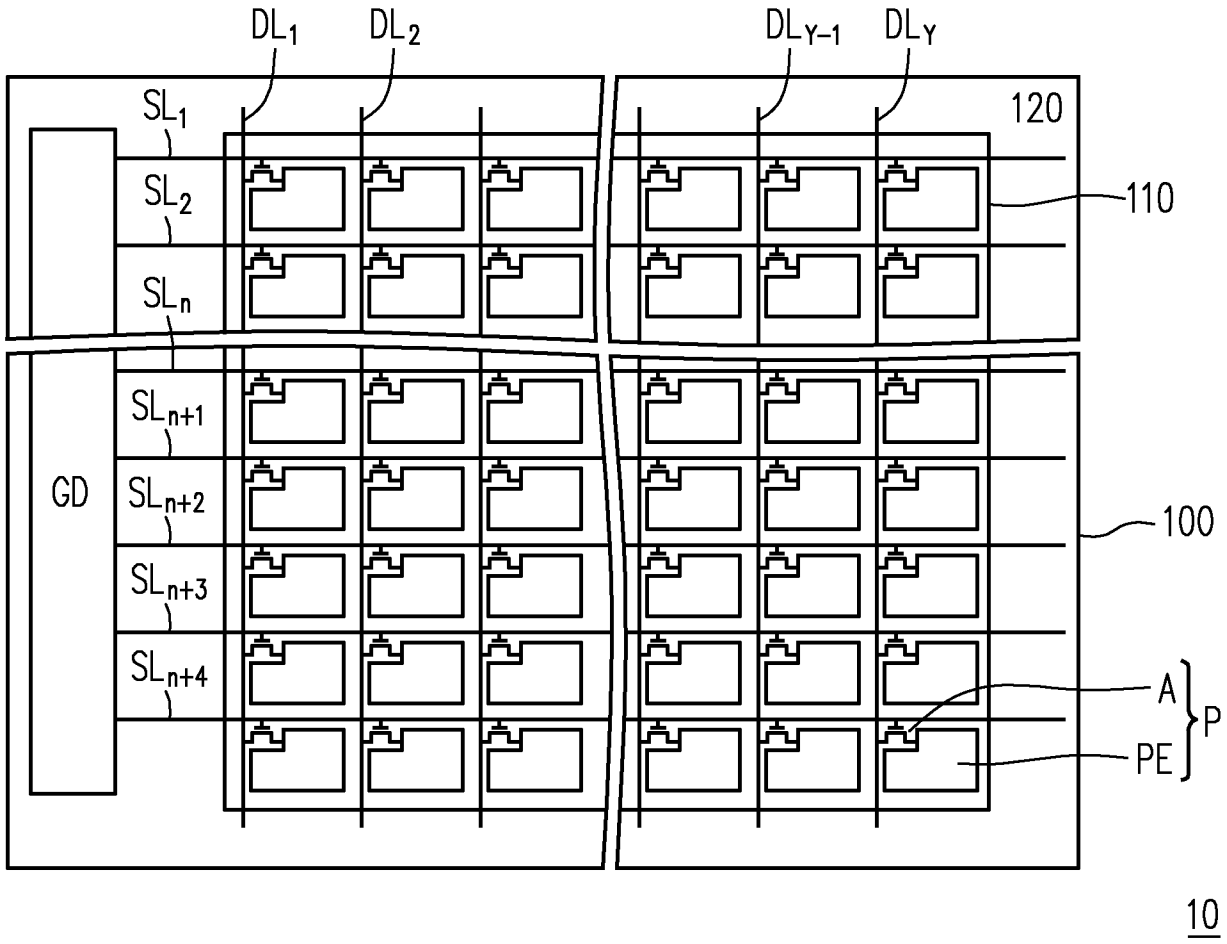
FIG. 1 is a top schematic view of a panel according to an embodiment of the present disclosure.

FIG. 1 is a top schematic view of a panel according to an embodiment of the present disclosure.

Referring to FIG. 1, the panel 10 includes a substrate 100, a gate driver GD, a plurality of scan lines $SL_1$-$SL_{n+4}$, a plurality of data lines $DL_1$-$DL_y$, and a plurality of pixel structures P. The substrate 100 has an active region 110 and a peripheral region 120 located on at least one side of the active region 110.

The gate driver GD is located on the peripheral region 120. The gate driver GD is, for example, a gate driver-on-array (GOA).

The plurality of scan lines $SL_1$-$SL_{n+4}$, the plurality of data lines $DL_1$-$DL_Y$, and the plurality of pixel structures P are located on the active region 110.

The scan lines $SL_1$-$SL_{n+4}$ are electrically connected to the gate driver GD. In the present embodiment, the gate driver GD supplies gate signals of all stages respectively to the scan lines $SL_1$-$SL_{n+4}$ in a single-sided single-drive manner. However, the present disclosure is not limited thereto. In other embodiments, gate signals of all stages can be respectively supplied to the scan lines $SL_1$-$SL_{n+4}$ by using a double-sided single-drive technique or a double-sided double-drive technique. The scan lines $SL_1$-$SL_{n+4}$ and the data lines $DL_1$-$DL_Y$ are disposed to intersect each other, and an insulating layer is sandwiched between the scan lines $SL_1$-$SL_{n+4}$ and the data lines $DL_1$-$DL_Y$. In other words, the extending direction of the scan lines $SL_1$-$SL_{n+4}$ is not parallel to the extending direction of the data lines $DL_1$-$DL_Y$. Preferably, the extending direction of the scan lines $SL_1$-$SL_{n+4}$ is perpendicular to the extending direction of the data lines $DL_1$-$DL_Y$. Based on conductivity considerations, the scan lines $SL_1$-$SL_{n+4}$ and the data lines $DL_1$-$DL_Y$ are generally made of a metal material. However, the present disclosure is not limited thereto, and according to other embodiments, the scan lines $SL_1$-$SL_{n+4}$ and the data lines $DL_1$-$DL_Y$ may also be made of other conductive materials, for example, an alloy, a nitride of a metal material, an oxide of a metal material, an oxynitride of a metal material or other suitable materials or a stacked layer of a metal material and other conductive materials.

The pixel structure P includes an active device A and a pixel electrode PE. The active device A may be a bottom-gate thin film transistor or a top-gate thin film transistor, including a gate, a channel, a source and a drain. The active device A is electrically connected to a corresponding one of the scan lines $SL_1$-$SL_{n+4}$ and a corresponding one of the data lines $DL_1$-$DL_Y$. In addition, the active device A is electrically connected to the pixel electrode PE. In the present embodiment, the active region 110 can be used as a display region, and an array of the pixel structures P located in the active region 110 can be matched with a liquid crystal layer (not shown), an opposite substrate (not shown) and a backlight module (not shown) to display a picture. However, the present disclosure is not limited thereto. In other variations, the active region 110 can be used as a display region, and an array of the pixel structures P located in the active region 110 can be matched with an electroluminescent element to display the picture.

Figure 2:
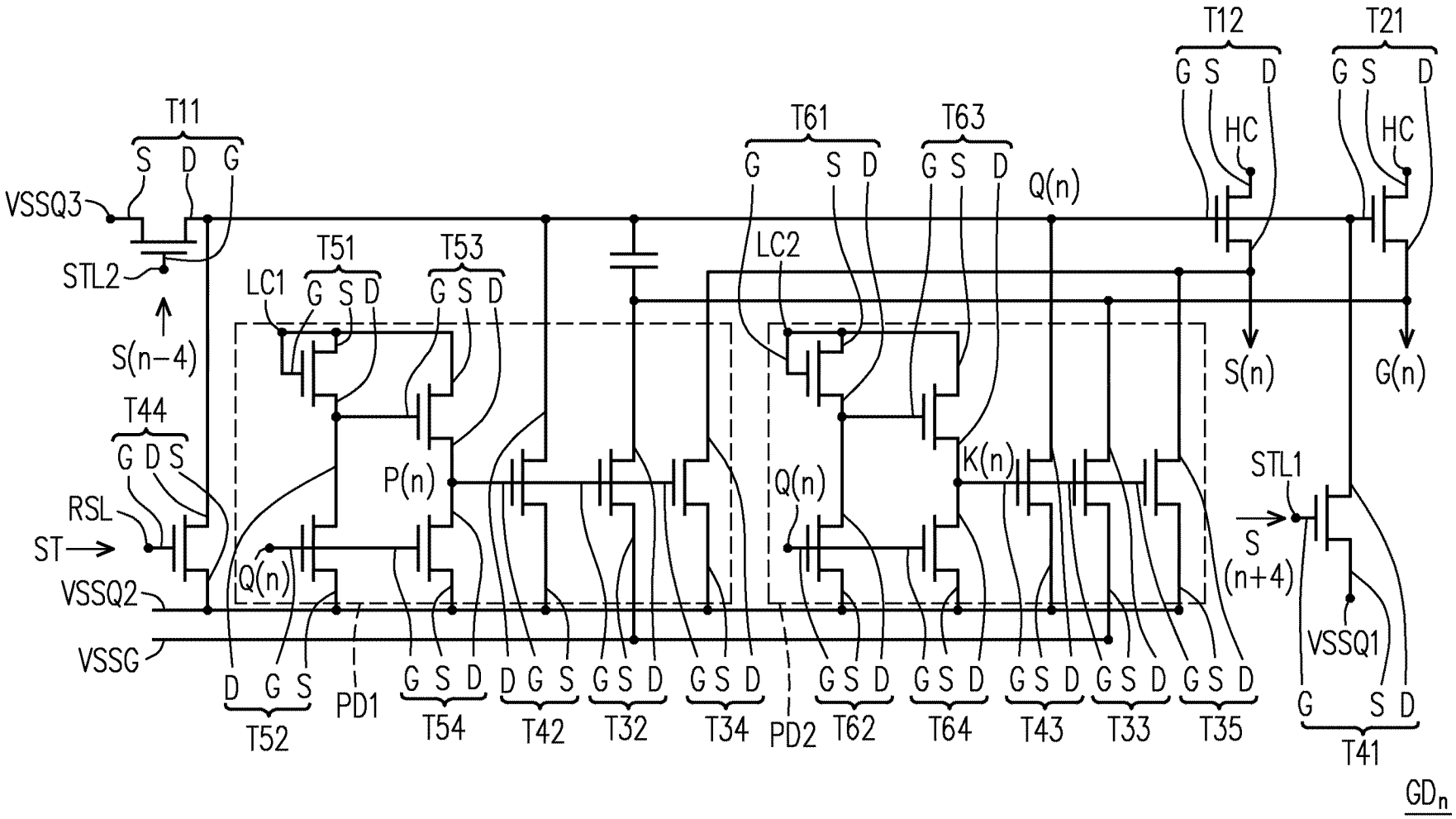
FIG. 2 is a partial circuit schematic view of a panel according to an embodiment of the present disclosure.

FIG. 2 is a partial circuit schematic view of a panel according to an embodiment of the present disclosure. For example, FIG. 2 is a partial circuit schematic view of the panel 10 in FIG. 1. In the present embodiment, the gate driver GD of the panel 10 includes a 1st-stage driver unit to a (n+4)th-stage driver unit. The 1st-stage driver unit to the (n+4)th-stage driver unit are electrically connected to the scan lines $SL_1$-$SL_{n+4}$ respectively, and the 1st-stage driver unit to the (n+4)th-stage driver unit respectively output corresponding gate driving signals to the scan lines $SL_1$-$SL_{n+4}$. The 1st-stage driver unit to the (n+4)th-stage driver unit have a similar circuit design. Therefore, for convenience of description, only a circuit schematic view of the nth-stage driver unit $GD_n$ is shown in FIG. 2.

Figure 3A:
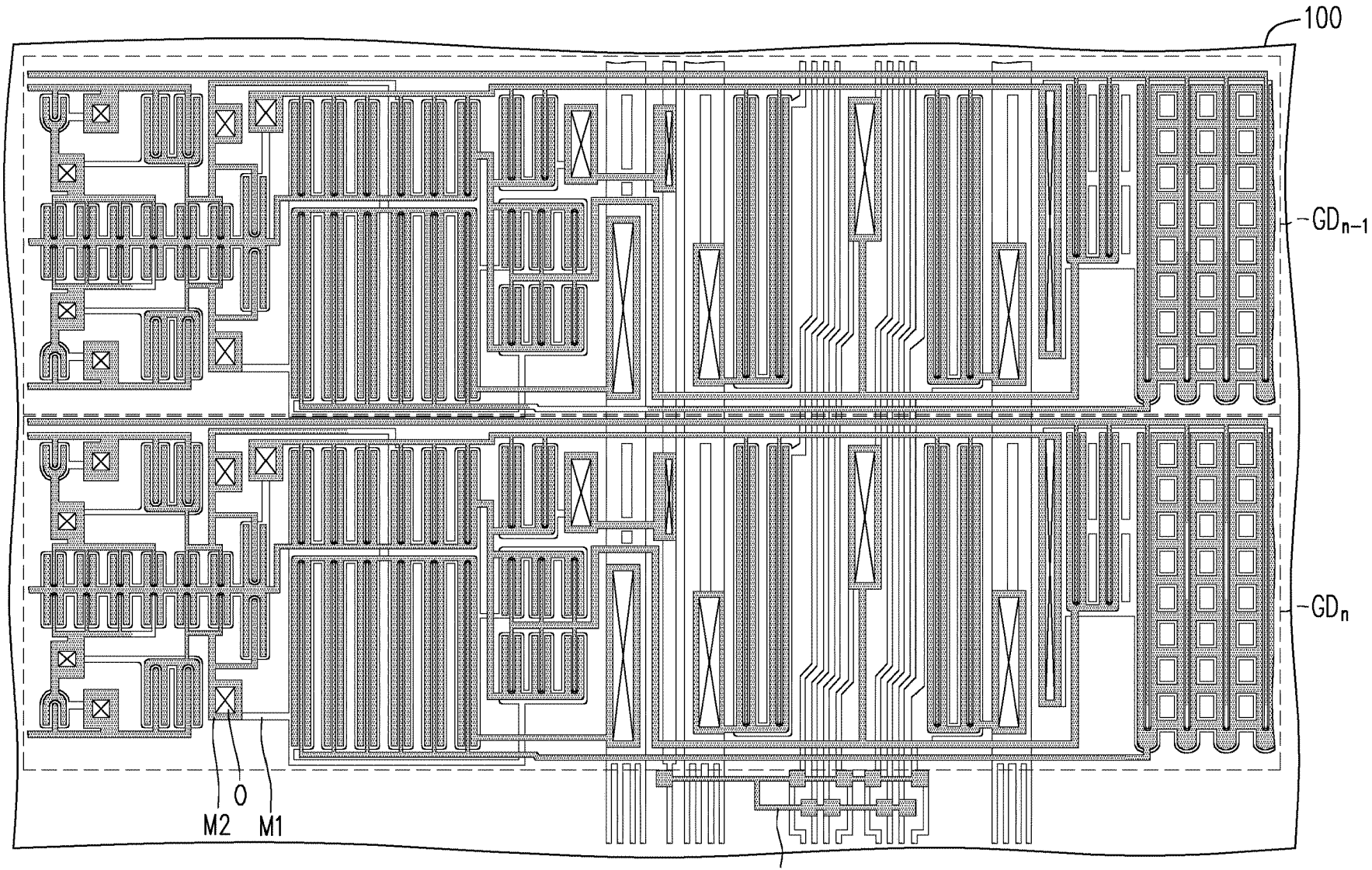
FIG. 3A is a partial enlarged schematic view of FIG. 1.
Figure 3B:
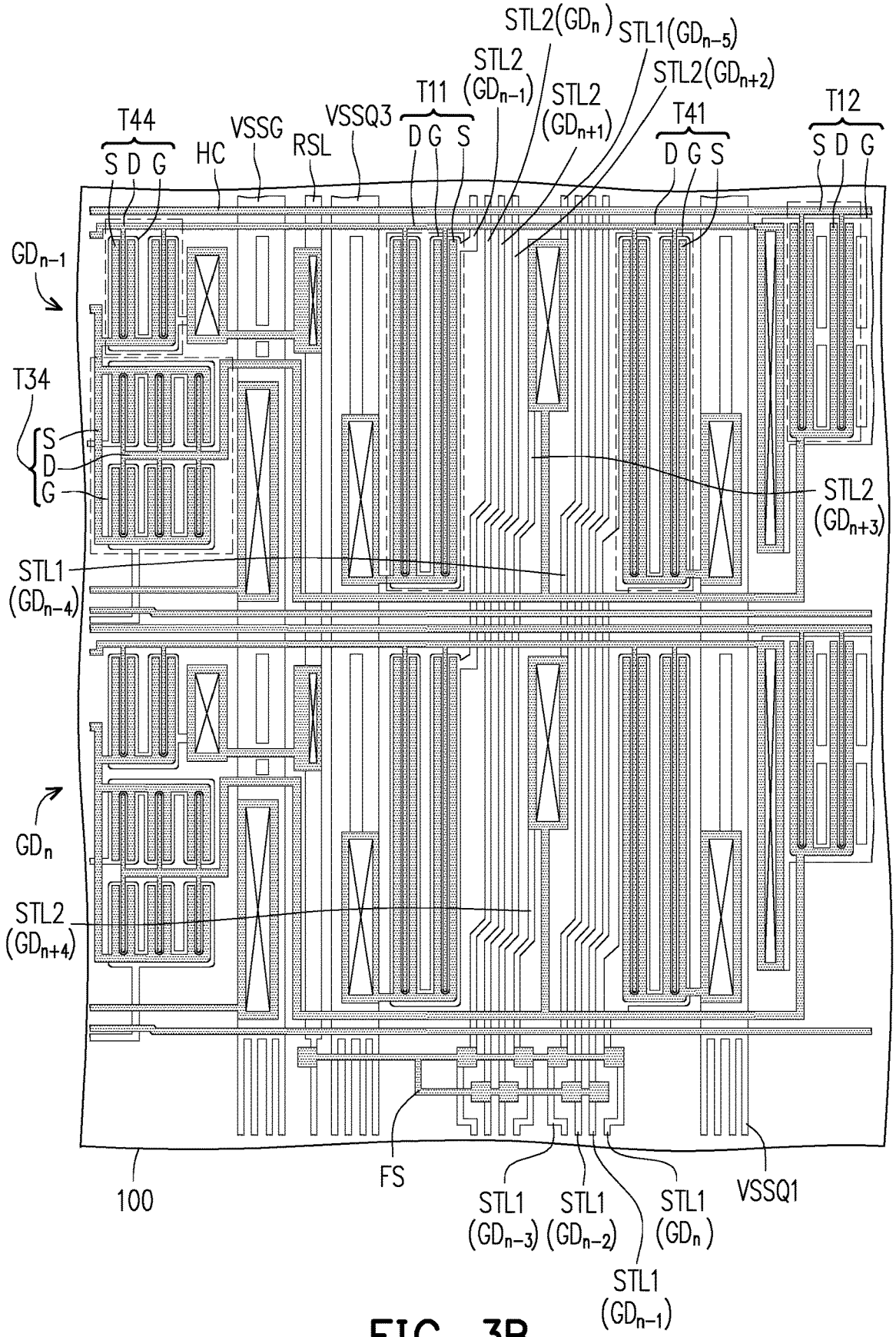
FIG. 3B is a partial enlarged schematic view of FIG. 3A.

FIG. 3A is a partial enlarged schematic view of FIG. 1. FIG. 3B is a partial enlarged schematic view of FIG. 3A. FIG. 3A shows a portion of the nth-stage driver unit $GD_n$ and a portion of the (n−1)th-stage driver unit $GD_{n-1}$. In the present embodiment, the gate driver GD further includes a plurality of connection structures FS, and every two stages of driver units share one connection structure FS. For example, the 1st-stage driver unit and the 2nd-stage driver unit share the connection structure FS located between the 2nd-stage driver unit and the 3rd-stage driver unit, and the 3rd-stage driver unit and the 4th-stage driver unit share the connection structure FS located between the 4th-stage driver unit and the 5th-stage driver unit. FIG. 3A and FIG. 3B also show a connection structure FS shared by the (n−1)th-stage driver unit and the nth-stage driver unit, and the connection structure FS shared by the (n−1)th-stage driver unit and the nth-stage driver unit is located between the nth-stage driver unit and the (n+1)th-stage driver unit (not shown in FIG. 3A and FIG. 3B).

Referring to FIG. 3A, the substrate 100 includes a first metal layer M1, a second metal layer M2, and a semiconductor pattern layer (not shown). A gate insulating layer (not shown) is sandwiched between the first metal layer M1 and the semiconductor pattern layer, a portion of the second metal layer M2 is electrically connected to the first metal layer M1 through an opening O, and the opening O penetrates at least the gate insulating layer. In the normal direction of the substrate 100, the substrate 100, the first metal layer M1, the gate insulating layer, the semiconductor pattern layer, and the second metal layer M2 are sequentially arranged, but the present disclosure is not limited thereto.

Referring to FIG. 1, FIG. 2, FIG. 3A and FIG. 3B, the panel 10 includes a substrate 100, a reset signal line RSL, a first voltage signal line VSSQ1, a second voltage signal line VSSQ2, a third voltage signal line VSSQ3, a fourth voltage signal line VSSG, a plurality of high-frequency clock signal lines HC, a first low-frequency clock signal line LC1 and a second low-frequency clock signal line LC2. The reset signal line RSL, the first voltage signal line VSSQ1, the second voltage signal line VSSQ2, the third voltage signal line VSSQ3, the fourth voltage signal line VSSG, the plurality of high-frequency clock signal lines HC, the first low-frequency clock signal line LC1 and the second low-frequency clock signal line LC2 are located on the substrate 100.

Each of the 1st-stage driver unit to the (n+4)th-stage driver unit includes a pulldown element T41, a reset element T44, an output element T21, and a first start signal line STL1. In the present embodiment, each of the 1st-stage driver unit to the (n+4)th-stage driver unit further include a pullup element T11, a second start signal line STL2, a transmission element T12, a first voltage stabilizing circuit PD1, and a second voltage stabilizing circuit PD2. In the present embodiment, the gate G of each element belongs to, for example, the first metal layer M1, the source S and the drain D of each element belong to, for example, the second metal layer M2, and a semiconductor pattern layer is sandwiched between the gate G and the source S of each element and between the gate G and the drain D.

In the nth-stage driver unit $GD_n$, the gate G of the pulldown element T41 is electrically connected to the first start signal line STL1 to receive the corresponding first start signal S(n+4) or the reset signal ST. The source S of the pulldown element T41 is electrically connected to the first voltage signal line VSSQ1 to receive the first voltage signal. In the present embodiment, the pulldown element T41 of the nth-stage driver unit $GD_n$ receives the first start signal S(n+4), and the pulldown element T41 of the (n−1)th-stage driver unit $GD_{n-1}$ receives the first start signal S(n+3), and the first start signals received by the pulldown elements T41 of the other driver units are deduced by analogy.

In the nth-stage driver unit $GD_n$, the gate G of the reset element T44 is electrically connected to the reset signal line RSL to receive the reset signal ST. The source S of the reset element T44 is electrically connected to the second voltage signal line VSSQ2 to receive the second voltage signal. The first voltage signal and the second voltage signal may be the same or different from each other. In the present embodiment, the first voltage signal and the second voltage signal are equal constant voltage signals. When the first voltage signal and the second voltage signal are the same signal, the first voltage signal line VSSQ1 and the second voltage signal line VSSQ2 may be the same signal line, but the present disclosure is not limited thereto.

In the nth-stage driver unit $GD_n$, the gate G of the output element T21 is electrically connected to the drain D of the pulldown element T41 and the drain D of the reset element T44. The source S of the output element T21 is electrically connected to the corresponding high-frequency clock signal line HC to receive the corresponding high-frequency clock signal. The drain D of the output element T21 is used for outputting a corresponding gate driving signal G(n). In the present embodiment, the output element T21 of the nth-stage driver unit $GD_n$ outputs the gate driving signal G(n) to the scan line $SL_n$, the output element T21 of the (n−1)th-stage driver unit $GD_{n-1}$ outputs the gate driving signal $G_{n-1}$ to the scan line $SL_{n-1}$, and the gate driving signals output by the output elements T21 of the other driver units are deduced by analogy.

In the nth-stage driver unit $GD_n$, the gate G of the pullup element T11 is electrically connected to the second start signal line STL2 to receive the corresponding second start signal S(n−4) or the reset signal ST. The source S of the pullup element T11 is electrically connected to the third voltage signal line VSSQ3 to receive the third voltage signal. In the present embodiment, the third voltage signal is a constant voltage signal, and has a voltage greater than the first voltage signal on the first voltage signal line VSSQ1 and the second voltage signal on the second voltage signal line VSSQ2. For example, the voltage of the third voltage signal is 30 volts, and the voltages of the first voltage signal and the second voltage signal are −9.5 volts, but the present disclosure is not limited thereto. In the present embodiment, the pullup element T11 of the nth-stage driver unit $GD_n$ receives the first start signal S(n−4), the pullup element T11 of the (n−1)th-stage driver unit $GD_{n-1}$ receives the first start signal S(n−5), and the first start signals received by the pullup elements T11 of the other driver units are deduced by analogy.

In the nth-stage driver unit $GD_n$, the gate G of the transmission element T12 is electrically connected to the drain D of the reset element T44, the drain D of the pulldown element T41, the gate G of the output element T21, and the drain D of the pullup element T11, and the gate G of the transmission element T12, the drain D of the reset element T44, the drain D of the pulldown element T41, the gate G of the output element T21, and the drain D of the pullup element T11 are electrically connected to a Q(n) point. The source S of the transmission element T12 is electrically connected to the corresponding high-frequency clock signal line HC to receive the corresponding high-frequency clock signal. In the present embodiment, the transmission element T12 and the output element T21 are electrically connected to the same high-frequency clock signal line HC to receive the same high-frequency clock signal. The drain D of the transmission element T12 is used for outputting a corresponding start signal S(n). In the present embodiment, the transmission element T12 of the nth-stage driver unit $GD_n$ outputs the start signal S(n), the transmission element T12 of the (n−1)th-stage driver unit $GD_{n-1}$ outputs a start signal S(n−1), and the first start signals output by the transmission elements T12 of the other driver units are deduced by analogy.

In the present embodiment, the transmission element T12 of the nth-stage driver unit $GD_n$ transmits the start signal S(n) to the pulldown element T41 of the (n−4)th-stage driver unit $GD_{n-4}$ and the pullup element T11 of the (n+4)th-stage driver unit $GD_{n+4}$.

The start signal S(n) output by the nth-stage driver unit $GD_n$ is the first start signal S(n) received by the (n−4)th-stage driver unit $GD_{n-4}$, and the first start signal line STL1 of the (n−4)th-stage driver unit $GD_{n-4}$ is electrically connected to the transmission element T12 of the nth-stage driver unit $GD_n$.

The start signal S(n) output by the nth-stage driver unit $GD_n$ is the second start signal S(n) received by the (n+4)th-stage driver unit $GD_{n+4}$, and the second start signal line STL2 of the (n+4)th-stage driver unit $GD_{n+4}$ is electrically connected to the transmission element T12 of the nth-stage driver unit $GD_n$.

The first voltage stabilizing circuit PD1 is electrically connected to the first low-frequency clock signal line LCT and the second voltage signal line VSSQ2 to receive the first low-frequency clock signal and the second voltage signal. In the present embodiment, the first voltage stabilizing circuit PD1 is further electrically connected to the fourth voltage signal line VSSG to receive a fourth voltage signal. The fourth voltage signal is, for example, a constant voltage signal, and has a voltage, for example, greater than the first voltage signal on the first voltage signal line VSSQ1 and the second voltage signal on the second voltage signal line VSSQ2. For example, the voltage of the fourth voltage signal is −8 volts, but the present disclosure is not limited thereto.

The second voltage stabilizing circuit PD2 is electrically connected to the second low-frequency clock signal line LC2 and the second voltage signal VSSQ2 to receive the second low-frequency clock signal and the second voltage signal. In the present embodiment, the second voltage stabilizing circuit PD2 is further electrically connected to the fourth voltage signal line VSSG to receive the fourth voltage signal. The first low-frequency clock signal and the second low-frequency clock signal are reverse signals.

In the present embodiment, the first voltage stabilizing circuit PD1 includes a first active device T51, a second active device T52, a third active device T53, a fourth active device T54, a fifth active device T42, a sixth active device T32, and a seventh active device T34.

In the nth-stage driver unit $GD_n$, the gate G of the first active device T51 and the source S of the first active device T51 are electrically connected to the first low-frequency clock signal line LC1. The drain D of the first active device T51 is electrically connected to the gate G of the third active device T53 and the drain D of the second active device T52.

In the nth-stage driver unit $GD_n$, the gate G of the second active device T52 and the gate G of the fourth active device T54 are electrically connected to the Q(n) point (a Q(n−1) point in the (n−1)th-stage driver unit $GD_{n-1}$, a Q(n−2) point in the (n−2)th-stage driver unit $GD_{n-2}$, and the points in the other driver units deduced by analogy). The source S of the second active device T52 and the source S of the fourth active device T54 are electrically connected to the second voltage signal line VSSQ2.

In the nth-stage driver unit $GD_n$, the source S of the third active device T53 is electrically connected to the first low-frequency clock signal line LC1. The drain D of the third active device T53 and the drain D of the fourth active device T54 are electrically connected to a P(n) point (a P(n−1) point in the (n−1)th-stage driver unit $GD_{n-1}$, a P(n−2) point in the (n−2)th-stage driver unit $GD_{n-2}$, and the points in the other driver units deduced by analogy).

In the nth-stage driver unit $GD_n$, the gate G of the fifth active device T42, the gate G of the sixth active device T32, and the gate G of the seventh active device T34 are electrically connected to the P(n) point (the P(n−1) point in the (n−1)th-stage driver unit $GD_{n-1}$, the P(n−2) point in the (n−2)th-stage driver unit $GD_{n-2}$, and the points in the other driver units deduced by analogy). The source S of the fifth active device T42 and the source S of the seventh active device T34 are electrically connected to the second voltage signal line VSSQ2. The source S of the sixth active device T32 is electrically connected to the fourth voltage signal line VSSG. The drain D of the fifth active device T42 is electrically connected to the Q(n) point (the Q(n−1) point in the (n−1)th-stage driver unit $GD_{n-1}$, the Q(n−2) point in the (n−2)th-stage driver unit $GD_{n-2}$, and the points in the other driver units deduced by analogy). The drain D of the sixth active device T32 is electrically connected to the drain D of the output element T21. The drain D of the seventh active device T34 is electrically connected to the drain D of the transmission element T12.

In the present embodiment, the second voltage stabilizing circuit PD2 includes a first active device T61, a second active device T62, a third active device T63, a fourth active device T64, a fifth active device T43, a sixth active device T33, and a seventh active device T35.

In the nth-stage driver unit $GD_n$, the gate G of the first active device T61 and the source S of the first active device T61 are electrically connected to the second low-frequency clock signal line LC2. The source S of the first active device T61 is electrically connected to the gate G of the third active device T63 and the drain D of the second active device T62.

In the nth-stage driver unit $GD_1$, the gate G of the second active device T62 and the gate G of the fourth active device T64 are electrically connected to the Q(n) point (the Q(n−1) point in the (n−1)th-stage driver unit $GD_{n-1}$, the Q(n−2) point in the (n−2)th-stage driver unit $GD_{n-2}$, and the points in the other driver units deduced by analogy). The source S of the second active device T62 and the source S of the fourth active device T64 are electrically connected to the second voltage signal line VSSQ2.

In the nth-stage driver unit $GD_n$, the source S of the third active device T63 is electrically connected to the second low-frequency clock signal line LC2. The drain D of the third active device T63 and the drain D of the fourth active device T64 are electrically connected to a K(n) point (a K(n−1) point in the (n−1)th-stage driver unit $GD_{n-1}$, a K(n−2) point in the (n−2)th-stage driver unit $GD_{n-2}$, and the points in the other driver units deduced by analogy).

In the nth-stage driver unit $GD_n$, the gate G of the fifth active device T43, the gate G of the sixth active device T33, and the gate G of the seventh active device T35 are electrically connected to the K(n) point (the K(n−1) point in the (n−1)th-stage driver unit $GD_{n-1}$, the K(n−2) point in the (n−2)th-stage driver unit $GD_{n-2}$, and the points in the other driver units deduced by analogy). The source S of the fifth active device T43 and the source S of the seventh active device T35 are electrically connected to the second voltage signal line VSSQ2. The source S of the sixth active device T33 is electrically connected to the fourth voltage signal line VSSG. The drain D of the fifth active device T43 is electrically connected to the Q(n) point (the Q(n−1) point in the (n−1)th-stage driver unit $GD_{n-1}$, the Q(n−2) point in the (n−2)th-stage driver unit $GD_{n-2}$, and the points in the other driver units deduced by analogy). The drain D of the sixth active device T33 is electrically connected to the drain D of the output element T21. The drain D of the seventh active device T35 is electrically connected to the drain D of the transmission element T12.

In the nth-stage driver unit $GD_n$ of the present embodiment, a capacitor is also sandwiched between the drain D of the sixth active device T32 and the Q(n) point and between the drain D of the sixth active device T33 and the Q(n) point, but the present disclosure is not limited thereto.

Figure 4:
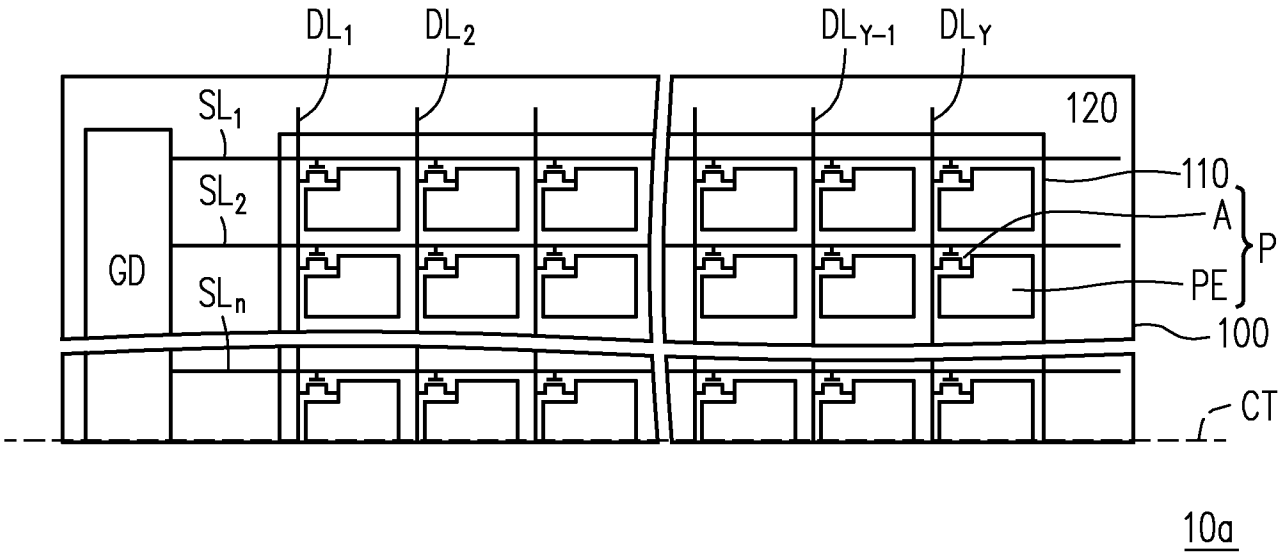
FIG. 4 is a top schematic view of a device substrate according to an embodiment of the present disclosure.

FIG. 4 is a top schematic view of a device substrate according to an embodiment of the present disclosure.

Referring to FIG. 4, the panel 10 (drawn in FIG. 1) is cut along the cutting line CT to obtain the device substrate 10*a*. In the present embodiment, the (n+1)th-stage driver unit $GD_{n+1}$ to the (n+4)th-stage driver unit $GD_{n+4}$ of the panel 10 (drawn in FIG. 1) are removed after cutting. The device substrate 10*a* includes a substrate 100, a reset signal line RSL, a first voltage signal line VSSQ1, a second voltage signal line VSSQ2, a third voltage signal line VSSQ3, a fourth voltage signal line VSSG, a plurality of high-frequency clock signal lines HC, a first low-frequency clock signal line LC1 and a second low-frequency clock signal line LC2. The reset signal line RSL, the first voltage signal line VSSQ1, the second voltage signal line VSSQ2, the third voltage signal line VSSQ3, the fourth voltage signal line VSSG, the plurality of high-frequency clock signal lines HC, the first low-frequency clock signal line LC1 and the second low-frequency clock signal line LC2 are located on the substrate 100.

Figure 5:
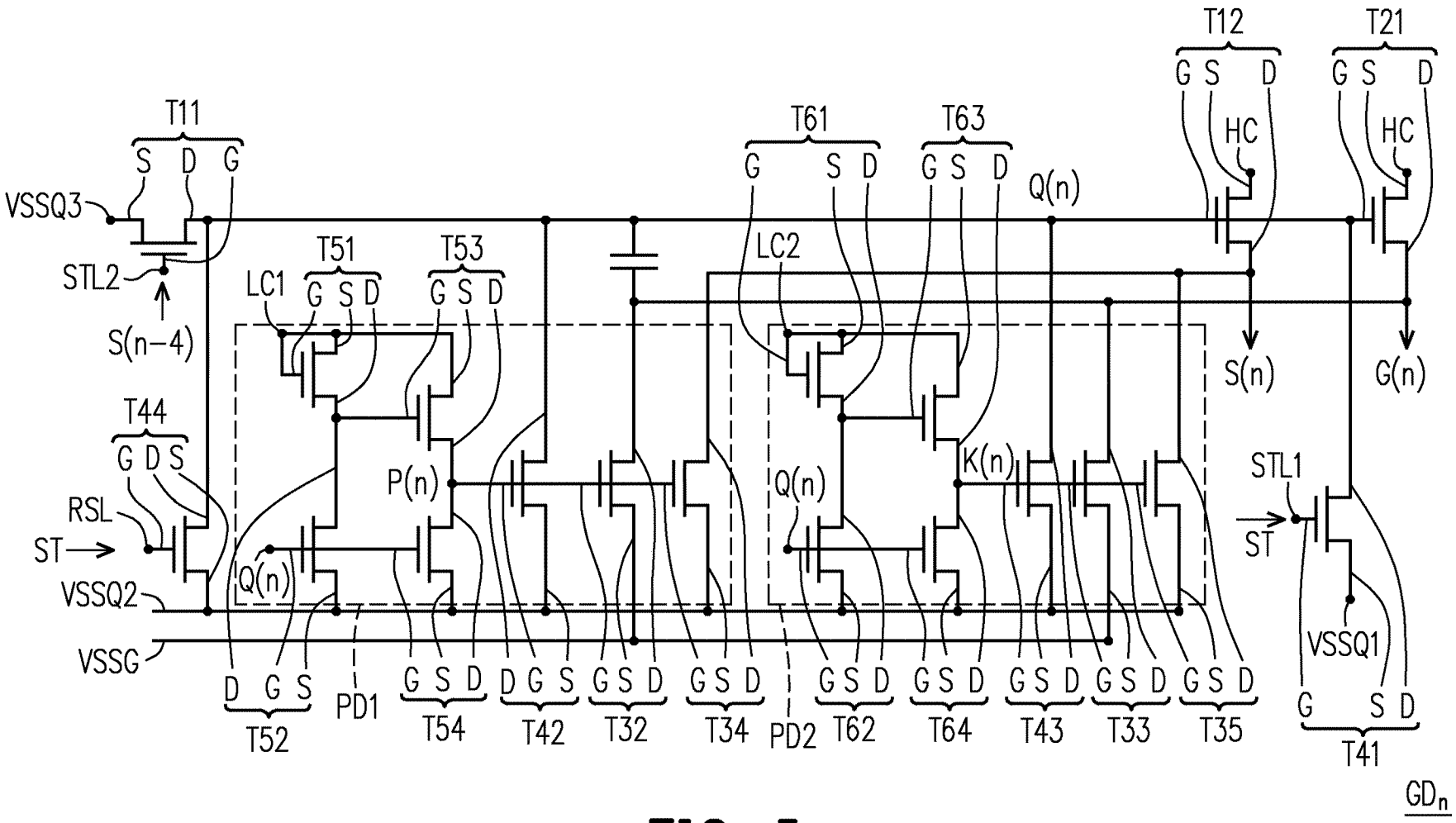
FIG. 5 is a partial circuit schematic view of a device substrate according to an embodiment of the present disclosure.

FIG. 5 is a partial circuit schematic view of a device substrate according to an embodiment of the present disclosure. For example, FIG. 5 is a partial circuit schematic view of the device substrate 10*a* of FIG. 4. In the present embodiment, the gate driver GD of the device substrate 10*a* includes the 1st-stage driver unit to the nth-stage driver unit. For convenience of description, only a circuit schematic view of the nth-stage driver unit $GD_n$ is shown in FIG. 5.

Figure 6A:
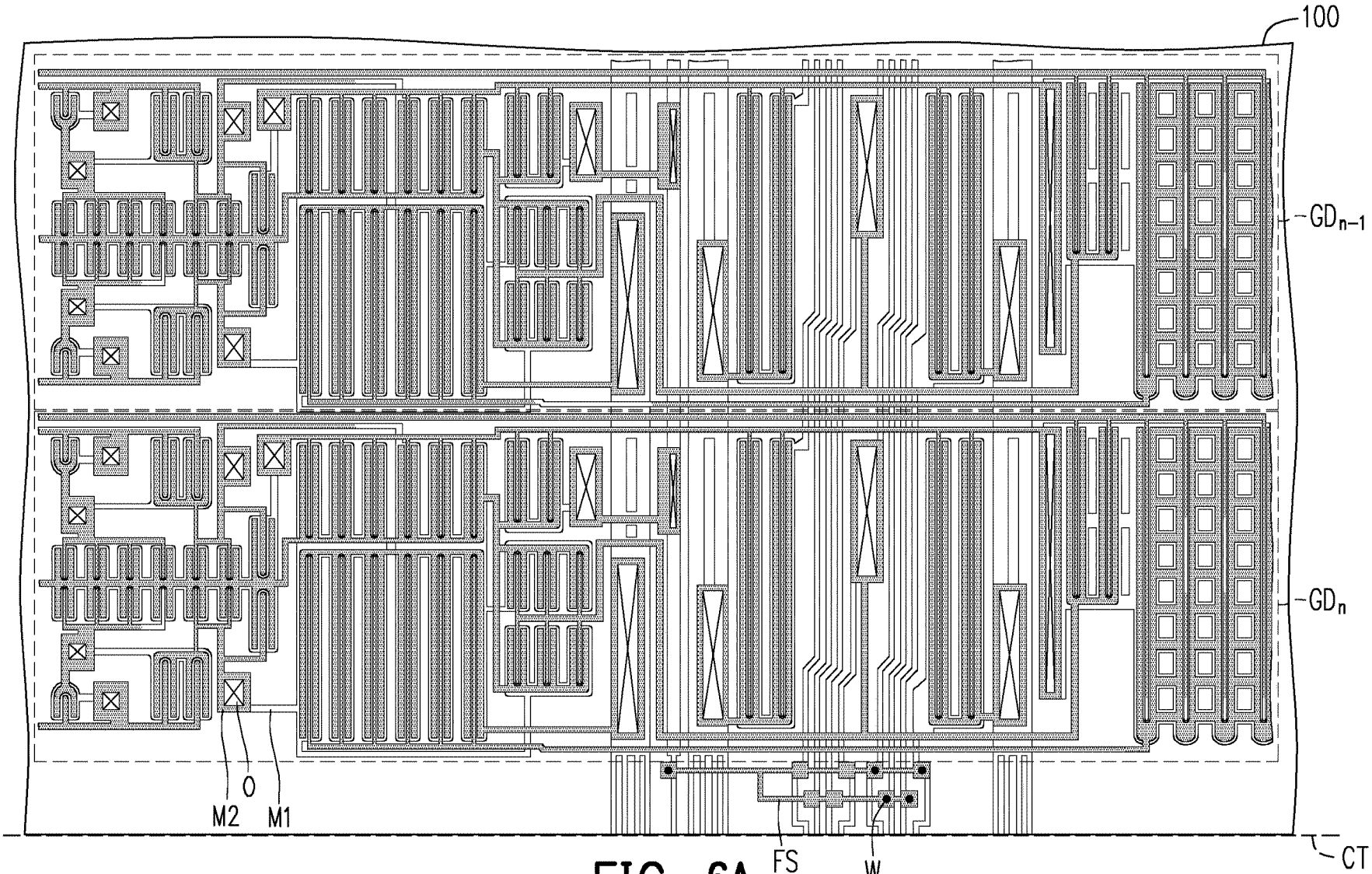
FIG. 6A is a partial enlarged schematic view of FIG. 4.
Figure 6B:
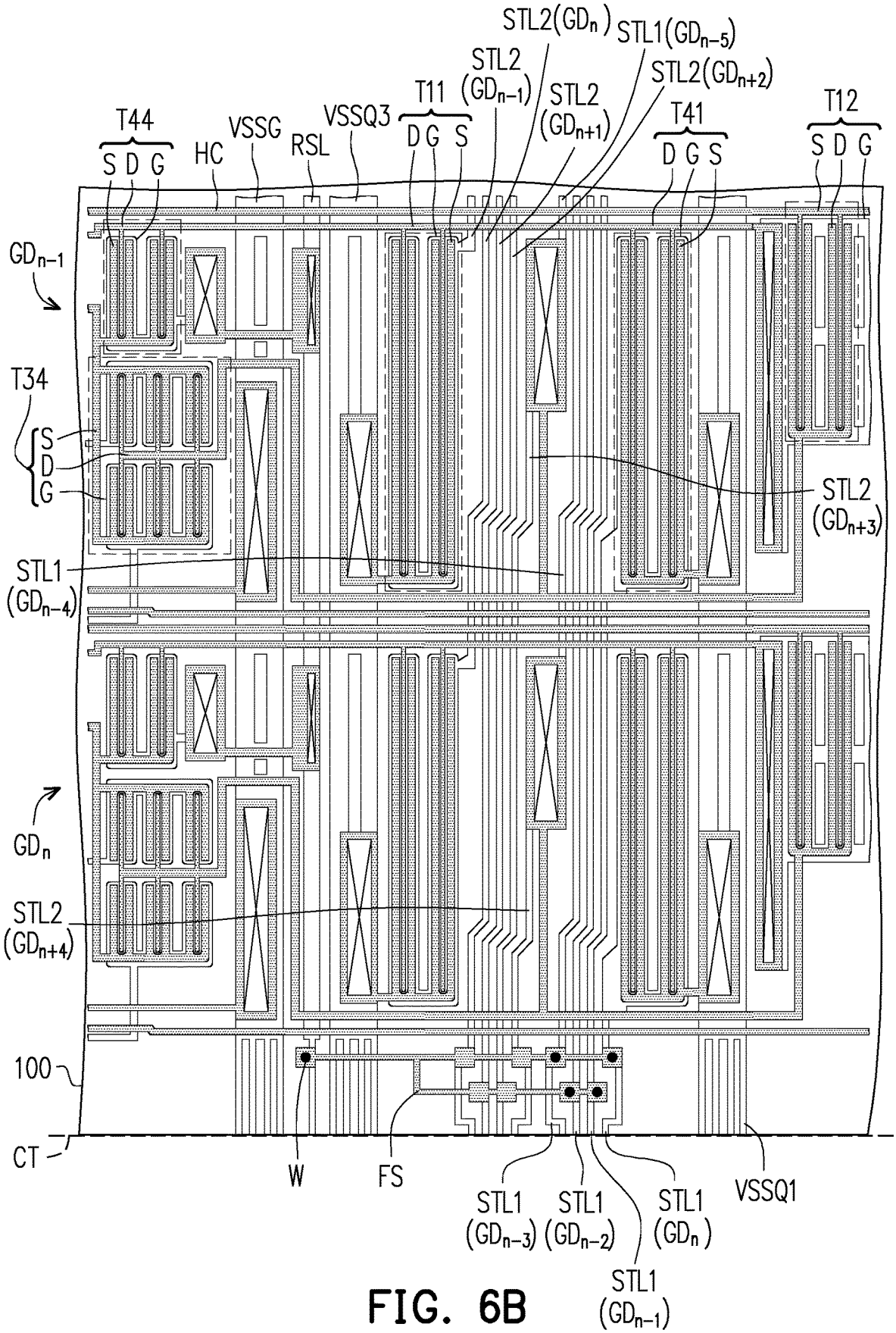
FIG. 6B is a partial enlarged schematic view of FIG. 6A.

FIG. 6A is a partial enlarged schematic view of FIG. 4. FIG. 6B is a partial enlarged schematic view of FIG. 6A.

Referring to FIG. 4, FIG. 5, FIG. 6A and FIG. 6B, in the present embodiment, the scanning sequence of the scan lines SL1-SLn is sequential scanning from the scan line SL1 to the scan line SLn. The (n+1)th-stage driver unit $GD_{n+1}$ to the (n+4)th-stage driver unit $GD_{n+4}$ to which the gates G of the pulldown elements T41 of the (n−3)th-stage driver unit $GD_{n-3}$ to the nth-stage driver unit $GD_n$ are originally connected have been removed after cutting.

If the gates G of the pulldown elements T41 of the (n−3)th-stage driver unit $GD_{n-3}$ to the nth-stage driver unit $GD_n$ are floating electrodes, the display function of the active region 110 is easily affected. In order to make signals generated by the (n−3)th-stage driver unit $GD_{n-3}$ to the nth-stage driver unit $GD_n$ relatively stable, the gates G of the pulldown elements T41 of the (n−3)th-stage driver unit $GD_{n-3}$ to the nth-stage driver unit $GD_1$ are electrically connected to the gate G of the reset element T44, so that the gate G of the pulldown element T41 receives the reset signal ST.

In the present embodiment, each connection structure FS is overlapped with the reset signal line RSL and the four first start signal lines STL1. For example, one of the connection structures FS is overlapped with the first start signal lines STL1 of the (n−3)th-stage driver unit $GD_{n-3}$ to the nth-stage driver unit $GD_n$. The first start signal line STL1 of the nth-stage driver unit $GD_n$ is fused with the reset signal line RSL. In the present embodiment, the fusing process is performed to form a plurality of fusion points W. By fusing (for example, a laser fusing process) the first start signal lines STL1 of the (n−3)th-stage driver unit $GD_{n-3}$ to the nth-stage driver unit $GD_n$ with the connection structure FS and fusing (for example, the laser fusing process) the reset signal line RSL with the connection structure FS, the first start signal lines STL1 of the (n−3)th-stage driver unit $GD_{n-3}$ to the nth-stage driver unit $GD_n$ are electrically connected to the reset signal line RSL.

In the present embodiment, the start signal is transmitted across four stages of driver units. For example, the start signal S(n+4) generated by the (n+4)th-stage driver unit $GD_{n+4}$ is transmitted to the nth-stage driver unit $GD_n$. Therefore, the four stages of driver units are subjected to the fusing process, so that the active region 110 of the main electric device substrate 10*a* can generate a stable signal, but the present disclosure is not limited thereto. In other embodiments, the start signal is transmitted across one stage of driver unit. For example, the start signal S(n+1) generated by the (n+1)th-stage driver unit $GD_{n+1}$ is transmitted to the nth-stage driver unit $GD_n$. Therefore, it is only necessary to perform a fusing process on the one stage of driver unit to make the active region of the main electric device substrate generate a stable signal. In other embodiments, the start signal is transmitted across two stages of driver units. For example, the start signal S(n+2) generated by the (n+2)th-stage driver unit $GD_{n+2}$ is transmitted to the nth-stage driver unit $GD_n$. Therefore, it is only necessary to perform a fusing process on the two stages of driver units to make the active region of the main electric device substrate generate a stable signal. In other words, the number of stages of driver units subjected to the fusing process can be adjusted according to actual needs.

Figure 7:
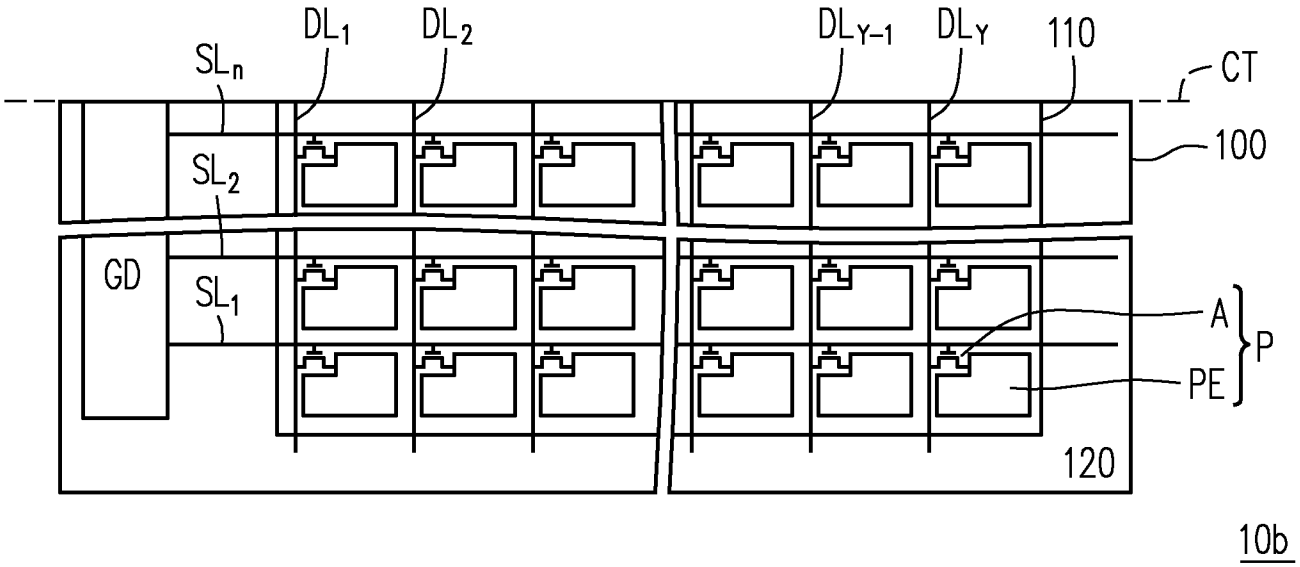
FIG. 7 is a top schematic view of a device substrate according to an embodiment of the present disclosure.
Figure 8:
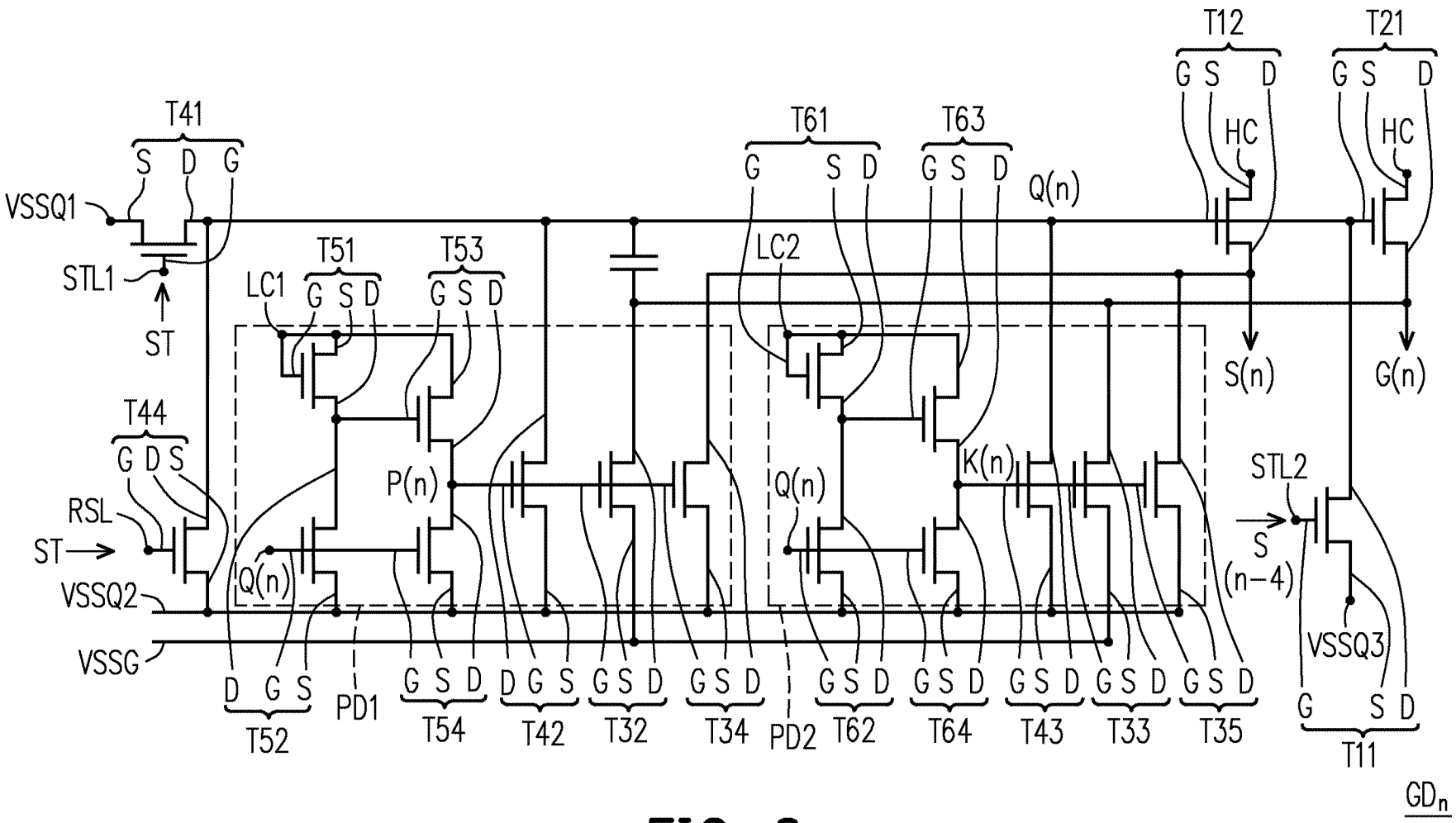
FIG. 8 is a partial circuit schematic view of a device substrate according to an embodiment of the present disclosure.
Figure 9A:
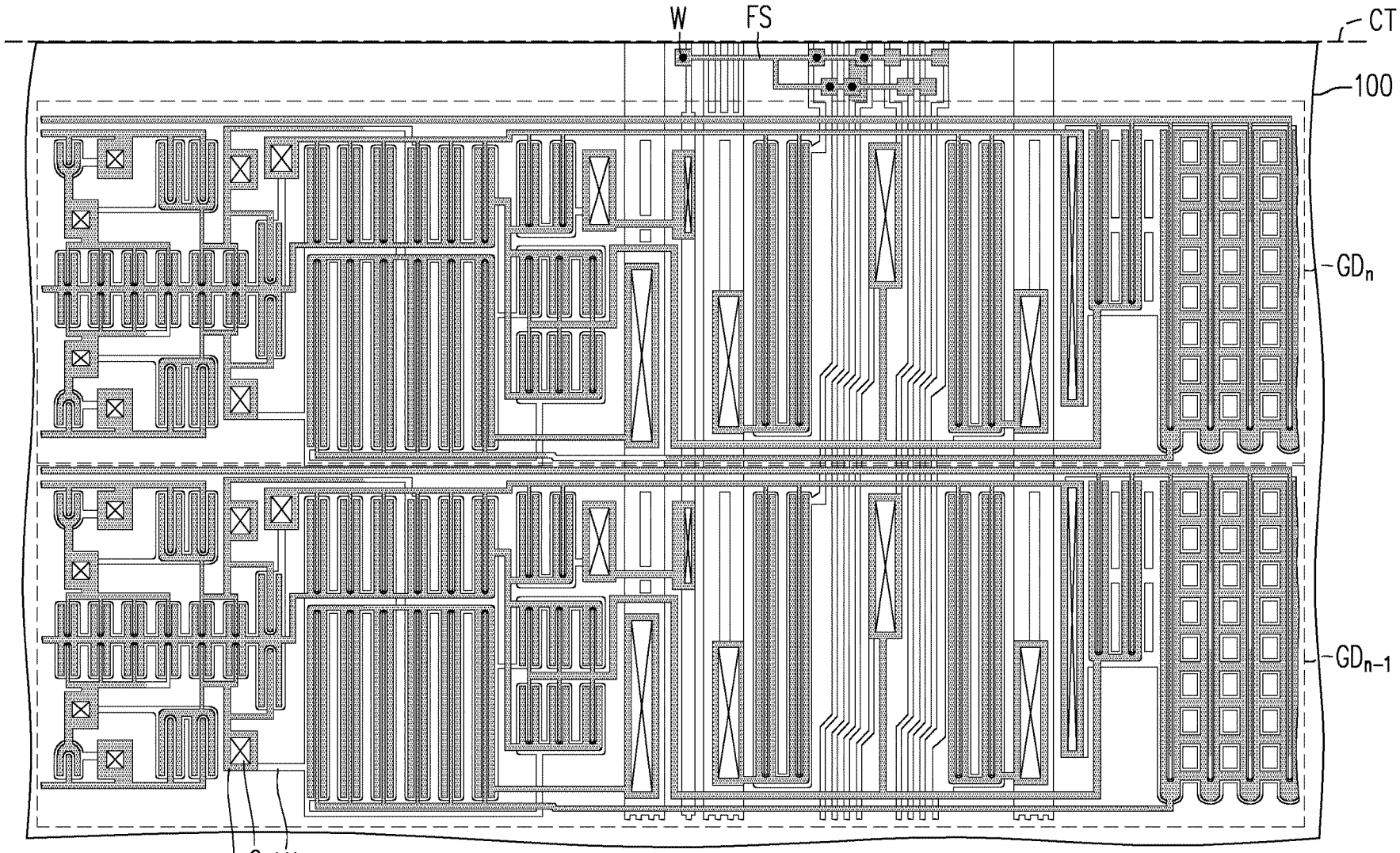
FIG. 9A is a partial enlarged schematic view of FIG. 7.
Figure 9B:
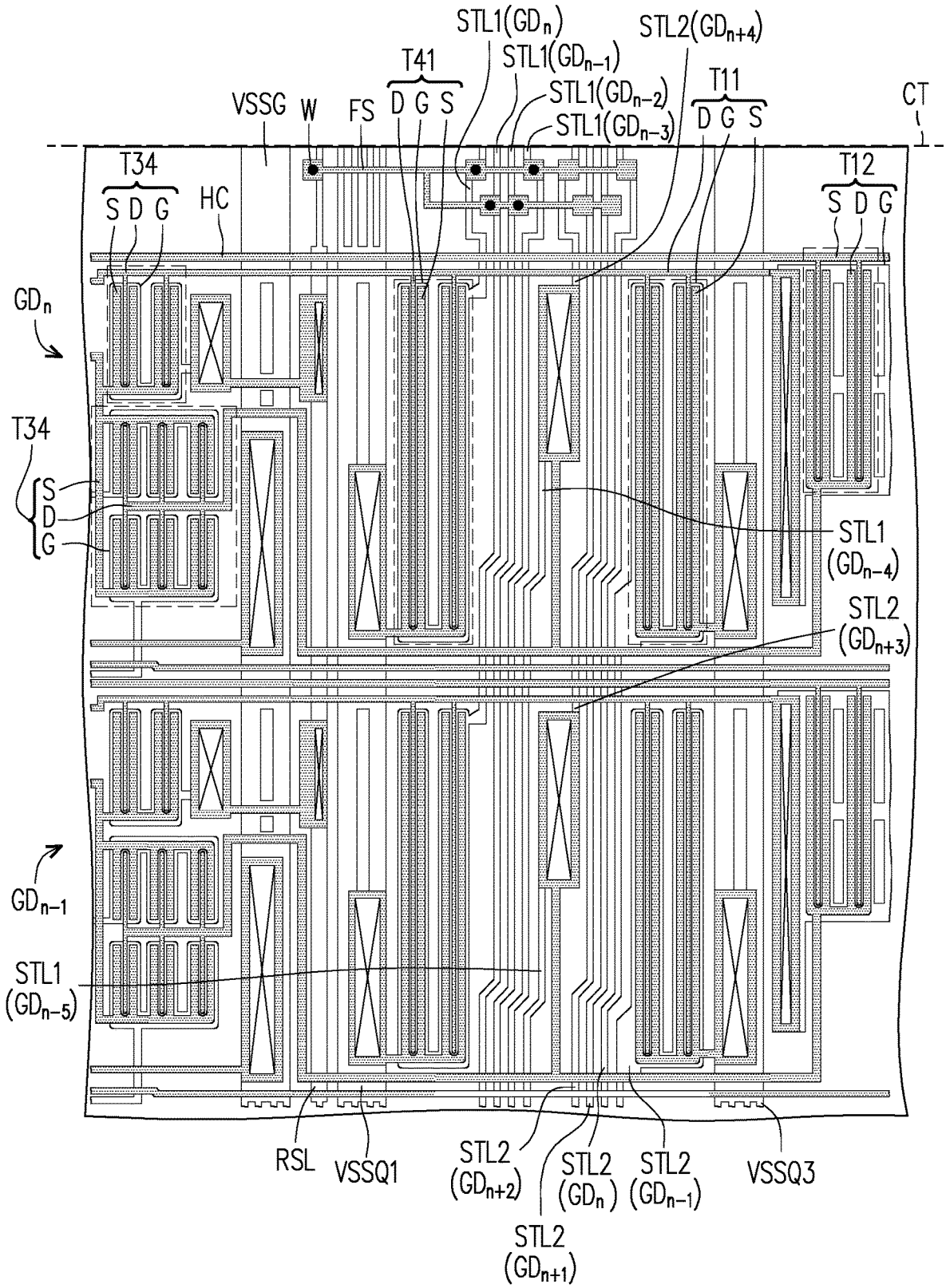
FIG. 9B is a partial enlarged schematic view of FIG. 9A.

FIG. 7 is a top schematic view of a device substrate according to an embodiment of the present disclosure. FIG. 8 is a partial circuit schematic view of a device substrate according to an embodiment of the present disclosure. FIG. 9A is a partial enlarged schematic view of FIG. 7. FIG. 9B is a partial enlarged schematic view of FIG. 9A.

It should be noted here that the embodiment of FIG. 7 to FIG. 9B follows the element symbols and partial contents of the embodiment of FIG. 4 to FIG. 6B. The same or similar symbols are used to denote the same or similar elements, and the description of the same technical contents is omitted. For the description of the omitted part, reference can be made to the foregoing embodiments, and the descriptions thereof are omitted herein.

The embodiment of FIG. 7 to FIG. 9B is mainly different from the embodiment of FIG. 4 to FIG. 6B in that: in the embodiment of FIG. 4 to FIG. 6B, the device substrate 10*a* is located on the upper side of the panel 10 (drawn in FIG. 1), and the 1st-stage driver unit $GD_1$ of the panel 10 is substantially equivalent to the 1st-stage driver unit $GD_1$ in the device substrate 10*a*; and in the embodiment of FIG. 7 to FIG. 9B, the device substrate 10*b* is located on the lower side of the panel 10 (drawn in FIG. 1), that is, a portion below the cutting line CT is taken as the device substrate 10*b*, and the last stage of driver unit of the panel 10 is substantially equivalent to the 1st-stage driver unit $GD_1$ in the device substrate 10*b*.

Referring to FIG. 1 and FIG. 7 to FIG. 9B, in the present embodiment, since the arrangement direction of the 1st-stage driver unit $GD_1$ to the nth-stage driver unit $GD_n$ of the device substrate 10*b* is different from that of the panel 10, the positions of the pulldown element T41 and the pullup element T11 of each of the 1st-stage driver unit $GD_1$ to the nth-stage driver unit $GD_n$ are mutually exchanged, and the positions of the first voltage signal line VSSQ1 and the third voltage signal line VSSQ3 are also mutually exchanged.

Based on the above, the present disclosure can relieve the problem of display abnormality of the display panel by making the pulldown element of the nth-stage driver unit receive the reset signal.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. A device substrate, comprising:

a substrate; and a 1st-stage driver unit to an nth-stage driver unit, located on the substrate, wherein n is a positive integer, and each of the 1st-stage driver unit to the nth-stage driver unit comprises:

a pulldown element, wherein a gate of the pulldown element is used for receiving a corresponding first start signal or a reset signal, and a source of the pulldown element is used for receiving a first voltage signal;

a reset element, wherein a gate of the reset element is used for receiving the reset signal, and a source of the reset element is used for receiving a second voltage signal; and an output element, wherein a gate of the output element is electrically connected to a drain of the pulldown element and a drain of the reset element, a source of the output element is used for receiving a corresponding high-frequency clock signal, and a drain of the output element is used for outputting a corresponding gate driving signal; wherein a gate of the pulldown element of the nth-stage driver unit is electrically connected with the gate of the reset element of the nth-stage driver unit so as to make the gate of the pulldown element of the nth-stage driver unit be used for receiving the reset signal.

2. The device substrate according to claim 1, wherein a gate of the pulldown element of the (n−1)th-stage driver unit is electrically connected with the gate of the reset element of the (n−1)th-stage driver unit so as to make the gate of the pulldown element of the (n−1)th-stage driver unit be used for receiving the reset signal.

3. The device substrate according to claim 1, wherein each of the 1st-stage driver unit to the nth-stage driver unit comprises:

a pullup element, wherein a gate of the pullup element is used for receiving a corresponding second start signal or the reset signal, and a source of the pullup element is used for receiving a third voltage signal.

4. The device substrate according to claim 1, wherein the first voltage signal and the second voltage signal are equal constant voltage signals.

5. The device substrate according to claim 1, wherein each of the 1st-stage driver unit to the nth-stage driver unit comprises:

a first voltage stabilizing circuit, used for receiving a first low-frequency clock signal and the second voltage signal; and a second voltage stabilizing circuit, used for receiving a second low-frequency clock signal and the second voltage signal, wherein the first low-frequency clock signal and the second low-frequency clock signal are reverse signals.

6. The device substrate according to claim 1, wherein each of the 1st-stage driver unit to the nth-stage driver unit comprises:

a transmission element, wherein a gate of the transmission element is electrically connected to the drain of the reset element, the drain of the pulldown element and the gate of the output element, a source of the transmission element is used for receiving the corresponding high-frequency clock signal, and a drain of the transmission element is used for outputting the corresponding start signal.

7. A device substrate, comprising:

a substrate;

a reset signal line, a first voltage signal line, a second voltage signal line and a plurality of high-frequency clock signal lines, located on the substrate; and a 1st-stage driver unit to an nth-stage driver unit, located on the substrate, wherein n is a positive integer, and each of the 1st-stage driver unit to the nth-stage driver unit comprises:

a first start signal line;

a pulldown element, wherein a gate of the pulldown element is electrically connected to the first start signal line, and a source of the pulldown element is electrically connected to the first voltage signal line;

a reset element, wherein a gate of the reset element is electrically connected to the reset signal line, and a source of the reset element is electrically connected to the second voltage signal line; and an output element, wherein a gate of the output element is electrically connected to a drain of the pulldown element and a drain of the reset element, a source of the output element is electrically connected to the corresponding high-frequency clock signal line, and a drain of the output element is used for outputting a corresponding gate driving signal; wherein the first start signal line of the nth-stage driver unit is electrically connected to the reset signal line.

8. The device substrate according to claim 7, wherein the first start signal line of the nth-stage driver unit is fused with the reset signal line.

9. The device substrate according to claim 7, wherein the first start signal line of the (n−1)th-stage driver unit is electrically connected to the reset signal line.

10. The device substrate according to claim 7, further comprising:

a third voltage signal line; wherein each of the 1st-stage driver unit to the nth-stage driver unit comprises:

a second start signal line; and a pullup element, wherein a gate of the pullup element is electrically connected to the second start signal line, and a source of the pullup element is electrically connected to the third voltage signal line.

11. The device substrate according to claim 7, wherein the first voltage signal line and the second voltage signal line are used for receiving equal constant voltage signals.

12. The device substrate according to claim 7, further comprising:

a first low-frequency clock signal line and a second low-frequency clock signal line; wherein each of the 1st-stage driver unit to the nth-stage driver unit comprises:

a first voltage stabilizing circuit, electrically connected to the first low-frequency clock signal line and the second voltage signal line; and a second voltage stabilizing circuit, electrically connected to the second low-frequency clock signal line and the second voltage signal line, wherein the first low-frequency clock signal line and the second low-frequency clock signal line are used for receiving reverse signals.

13. The device substrate according to claim 7, wherein each of the 1st-stage driver unit to the nth-stage driver unit comprises:

a transmission element, wherein a gate of the transmission element is electrically connected to the drain of the reset element, the drain of the pulldown element and the gate of the output element, a source of the transmission element is electrically connected to the corresponding high-frequency clock signal line, and a drain of the transmission element is used for outputting the corresponding start signal.

14. The device substrate according to claim 7, further comprising:

a connection structure, electrically connecting the first start signal line of the nth-stage driver unit to the reset signal line.

* * * * *